United States Patent [19]

Stern

[11] Patent Number: 4,669,951

[45] Date of Patent: Jun. 2, 1987

[54] AIR OPERATED MOTOR

[76] Inventor: Leif E. Stern, Fattershus, S-225 90 Lund, Sweden

[21] Appl. No.: 837,576

[22] Filed: Mar. 4, 1986

Related U.S. Application Data

[63] Continuation of Ser. No. 634,636, Jul. 26, 1984, abandoned.

[30] Foreign Application Priority Data

Jul. 28, 1983 [SE] Sweden ..... 8304174

[51] Int. Cl.[4] ..... F01D 1/36

[52] U.S. Cl. ..... 415/90; 416/231 R

[58] Field of Search ..... 415/80, 81, 90, 119, 415/121 G, 202, 76; 417/405, 406, 407; 403/335, 337; 416/231 R

[56] References Cited

U.S. PATENT DOCUMENTS

| | | | |
|---|---|---|---|
| 1,043,962 | 11/1912 | Nash | 415/76 |
| 1,056,338 | 3/1913 | Johnsen | 415/90 |
| 1,066,309 | 7/1913 | Nettle | 415/76 |
| 1,262,146 | 4/1918 | Ward | 416/231 R |
| 1,675,199 | 6/1928 | Smith | 415/121 G |
| 2,366,251 | 1/1945 | Fullemann | 416/186 R |
| 2,509,376 | 5/1950 | Trask | 416/231 R |
| 2,911,189 | 11/1959 | Von Ohain | 415/202 |
| 3,001,609 | 9/1961 | Macks | 416/231 R |
| 3,107,987 | 10/1963 | Duer | 415/121 G |
| 3,128,940 | 4/1964 | McDonald | 416/185 |
| 3,175,757 | 3/1965 | Laing | 416/187 |
| 3,733,147 | 5/1973 | Felker | 416/186 |
| 3,794,448 | 2/1974 | Albertson | 415/90 |
| 3,923,416 | 12/1975 | Frey | 415/90 |
| 4,120,618 | 10/1978 | Klaus | 417/420 |
| 4,232,992 | 11/1980 | Possell | 415/90 |
| 4,416,582 | 11/1983 | Glass | 415/90 |

FOREIGN PATENT DOCUMENTS

| | | | |
|---|---|---|---|
| 485101 | 3/1945 | Canada | 415/90 |
| 57821 | 6/1911 | Switzerland | 417/406 |
| 408690 | 4/1934 | United Kingdom . | |
| 882250 | 11/1961 | United Kingdom . | |
| 988854 | 4/1965 | United Kingdom . | |
| 1309699 | 3/1973 | United Kingdom . | |
| 1346762 | 2/1974 | United Kingdom . | |
| 1501473 | 2/1978 | United Kingdom . | |
| 1065773 | 12/1981 | United Kingdom . | |

*Primary Examiner*—Robert E. Garrett
*Assistant Examiner*—John Kwon
*Attorney, Agent, or Firm*—Bacon & Thomas

[57] ABSTRACT

An air operated motor for driving a pump, such as a solvent pump, the motor including a rotor formed from a body of porous material provided with a central opening, wherein a jet of compressed air is directed against the periphery of the rotor for rotating same, the air is caused to successively penetrate through the body of porous material for discharge from the central opening, thereby resulting in a high starting torque, low airflow loss and noiseless operation.

6 Claims, 2 Drawing Figures

AIR OPERATED MOTOR

This application is a continuation of application Ser. No. 634,636, filed 7-26-84, abandoned.

This invention relates to an air operated motor for driving pumps, preferably solvent pumps, comprising at least one compressed air operated rotor.

For compressed air operated motors of the type indicated desirable characteristics include a high starting torque, low flow losses and noiseless running. It has not, however, been possible hitherto to satisfy all these requirements at one and the same time, especially where high speed motors are concerned.

The object of the present invention therefore is to provide an air operated motor of the aforementioned type, with a high starting torque, low flow losses and noiseless running. This is achieved according to the invention substantially in that the compressed air operated motor has been provided characteristic features hereinafter to be defined.

Figure 1:
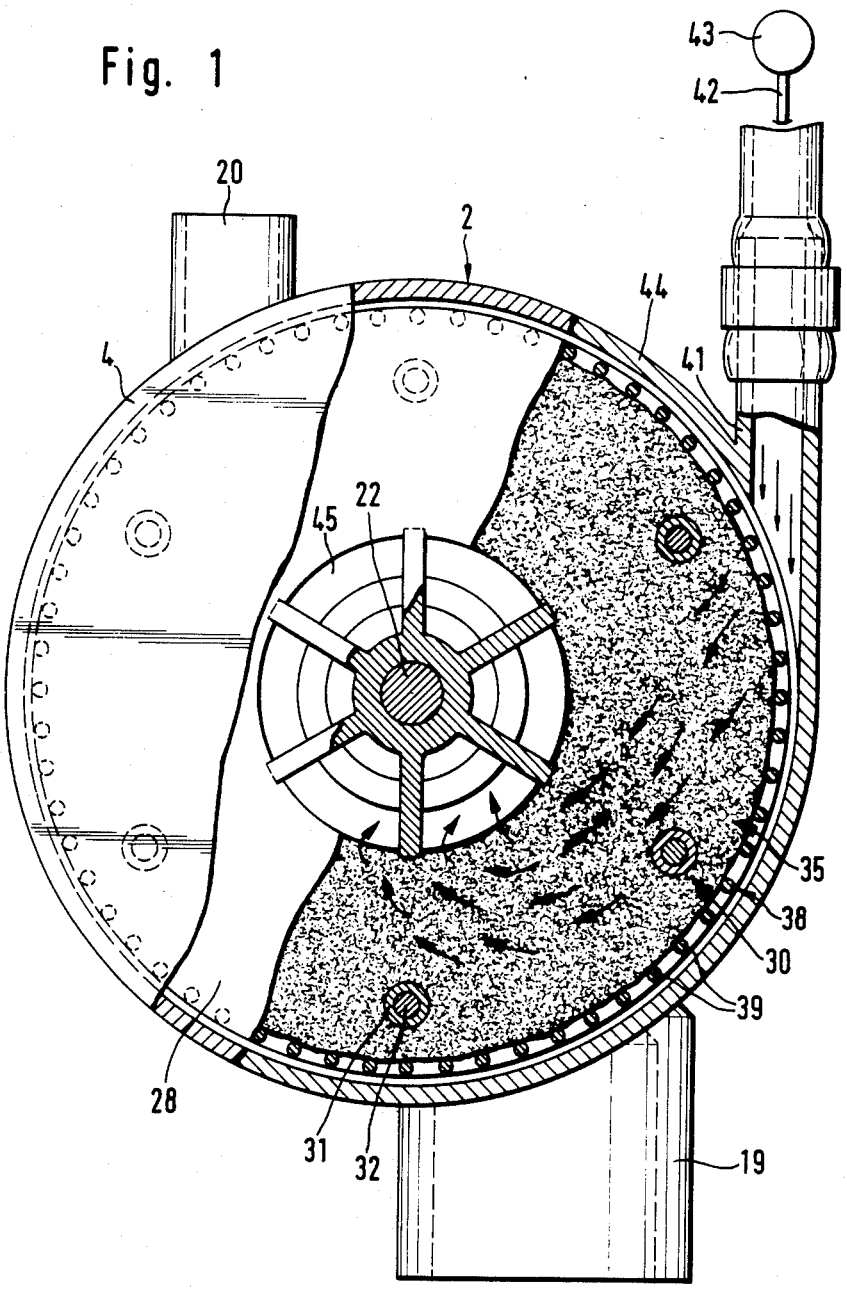
Figure 2:
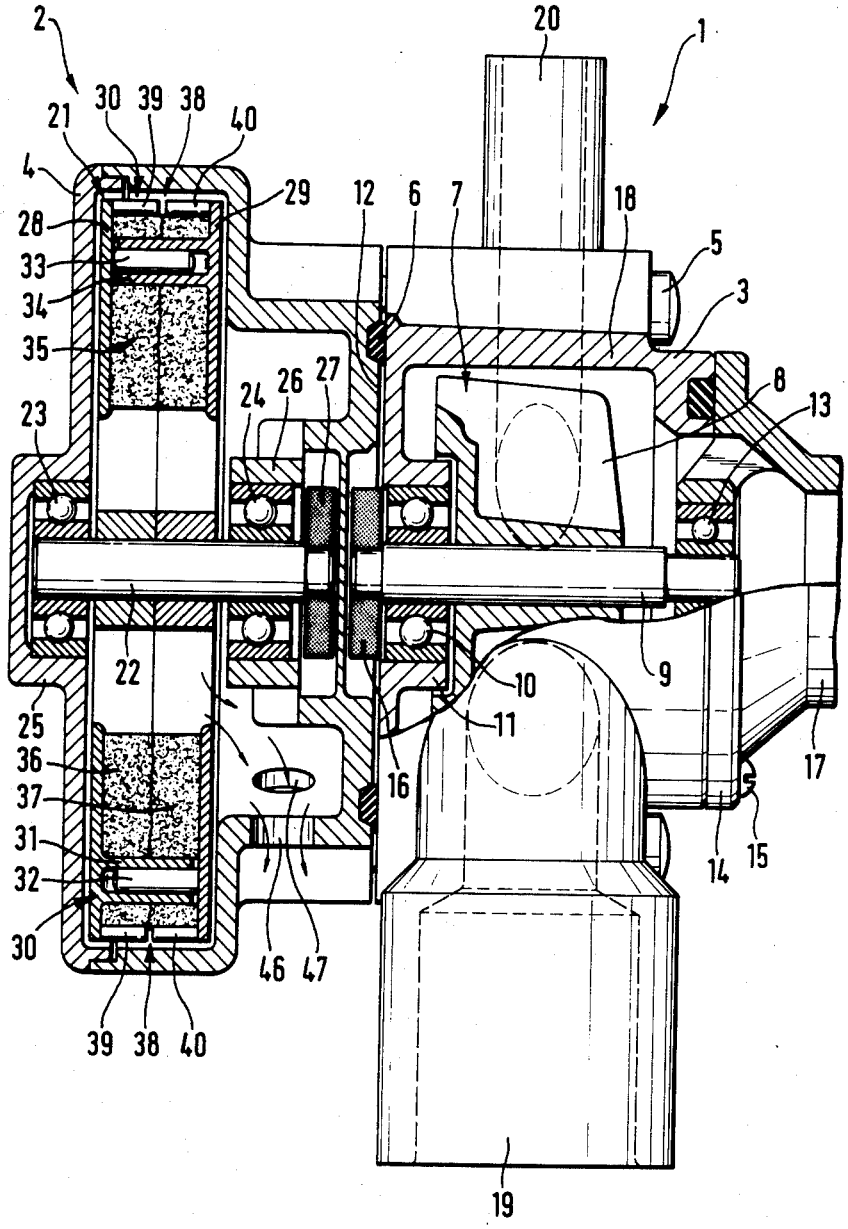

The invention will now be elucidated in more detail below with reference to the accompanying drawings in which:

FIG. 1 shows a motor according to the invention in plan view and partly in section, and FIG. 2 shows this motor in side view and partly in section.

The drawings illustrate a pump 1 for solvents and an air operated motor 2 for driving the pump 1. The pump 1 has a pump housing 3 and the motor 2 has a motor casing 4, said housing and said casing being screwed together with the aid of screwed connections 5 and sealed by means of a sealing ring 6. In the pump housing 3 is arranged a rotor 7 with three or any other suitable number of rotor wings 8. The rotor 7 has a rotor shaft 9 arranged in a ball bearing 10 which is mounted in an annular flange 11 projecting from one end wall of the pump housing 3. The rotor shaft 9 is also mounted in a ball bearing 13 disposed on a tubular flange 14 which is screwed to the pump housing 3 by screws 15. Close to one end wall of the motor casing 4 the rotor shaft 9 presents an annular permanent magnet 16. The tubular flange 14 has a pipe 17 for central admission of solvent into the interior of the pump housing 3. The wall 18 of the pump housing 3 which surrounds the rotor 7 has one or more discharge pipes 19 and/or 20 for solvent.

The motor casing 4 contains a rotor 21 with a rotor shaft 22 mounted in two ball bearings 23, 24 which are arranged in annular flanges 25, 26 on the walls of the motor casing. Close to one end wall 12 of the motor casing 4 the rotor shaft 22 has a permanent magnet 27 which is located opposite the permanent magnet 16.

The rotor 21 has an outer and an inner disk 28 and 29, respectively, which are kept together by assembling means 30. For the formation of said assembling means 30 the outer disk 28 has a number of sleeves 31 and between them a number of pins 33. The inner disk 29 also has a number of pins 32 and a number of sleeves 34 disposed between the pins. All pins and sleeves are so formed and dimensioned as to engage in each other and be retained to each other by friction. Between the disks 28, 29 is arranged a porous material 35, preferably a fibrous plastics material. The porous material 35 may be in the form of an outer and an inner circular disk 36, 37, the outer circular disk 36 being placed on the outer rotor side wall disk 28 and retained thereto with the aid of the sleeves and pins 31, 33 of said disks. The inner circular disk 37 is placed on the inner rotor side wall disk 29 and retained thereto with the aid of the pins and sleeves 32, 34 of said disk. The thickness of the circular disks 36, 37 is so chosen that the disks are in contact with one another when the rotor side wall disks 28, 29 are spaced a minimum distance apart. Around the porous material 35 there extends an air-permeable protective and/or supporting member 38 which in the embodiment illustrated is formed by ribs 39 on the outer side wall disk 28 and ribs 40 directed against them on the inner side wall disk 29. The ribs 39, 40 may extend altogether or substantially up to each other.

The pump housing has a compressed air supply pipe 41 which is connected via a conduit 42 to a source of compressed air 43. The compressed air supply pipe 41 opens in a wall 44 which surrounds the porous material 35, and conducts the compressed air such that it flows into the motor casing 4 substantially in a tangential direction in relation to the porous material 35. As a result, the compressed air will hit the protective and/or supporting member 38 and flow through said member 38 into the porous material 35, escaping therefrom through a central opening 45. The air will then pass out of the motor casing 4 via outlet openings 46, 47 therein. The compressed air will thus rotate the rotor 21 under successive penetration into the porous material 35. This successive penetration of the compressed air into the porous material 35 implies a successively decreasing air velocity, which allows for a high starting torque and low flow losses. At the same time, the porous material 35 dampens the discharge sound, i.e. it constitutes an effective sound absorber. In operation the protective and/or supporting member 38 protects the porous material 35 from being torn to pieces by the incoming jet of compressed air and/or from being thrown away by centrifugal force.

The rotor 21 transmits its rotary movement to the rotor 7 as the permanent magnet 27 cooperates with the permanent magnet 16. At the rotation of the rotor 7 the rotor wings 8 will suck in solvent via the pipe 17 and force it out via the discharge pipe 19 and/or the discharge pipe 20.

The motor according to the invention may be varied within the scope of the appended claims. Thus, the rotor 21 of the motor 2 may be given a form other than that described above and shown in the drawings. Of primary importance is that the compressed air is conducted so as to flow through the porous material to drive the rotor 21, but this material may be formed and arranged in various ways, which also applies to the other parts of the rotor 21. The porous material may for instance be formed as a single circular disk, and the protective and/or supporting member extending around the porous material may be formed in a way other than that described above.

The air operated motor according to the invention can of course be employed to drive other kinds of pumps than solvent pumps.

I claim:

1. An air operated motor for driving a pump, such as a solvent pump, comprising:

(a) a casing;

(b) A rotor supported for rotation within the casing;

(c) means for directing a driving jet of compressed air substantially tangentially against the periphery of the rotor for rotating same;

(d) the rotor being formed from a body of porous material in the configuration of at least one disk and having a structure permitting the driving jet of compressed air to successively penetrate therethrough and towards the central portion of the rotor for producing high starting torque and low airflow loss;

(e) the rotor including a pair of spaced sidewalls and means for securing the sidewalls together, with the body of porous material being disposed between the sidewalls;

(f) an air permeable means extending peripherally around the porous material for protecting and supporting same, the air permeable means including a plurality of spaced ribs having their longitudinal axes disposed parallel to the rotor axis of rotation;

(g) a rotor shaft for rotatably supporting the rotor within the casing, wherein the rotor shaft includes means for providing an operative engagement between the rotor shaft and a pump shaft for driving a pump; and (h) the casing including an opening for discharging the air from the central portion of the rotor.

2. The motor of claim 1 wherein the central portion of the rotor includes an opening disposed in communication with the casing opening.

3. The motor of claim 1 wherein the means for securing the sidewalls together includes a plurality of spaced pins and sleeves carried by one sidewall for engagement with a plurality of corresponding spaced pins and sleeves carried by the other sidewall.

4. The motor of claim 1 wherein the body of porous material is in the configuration of two disks disposed in abutting engagement with each other.

5. The motor of claim 1 wherein the body of porous material is formed from fibrous plastic.

6. The motor of claim 1 further including means for providing an indirect operative engagement between the rotor shaft and the pump for driving the pump, wherein the means for indirect operative engagement includes a magnetic coupling means.

* * * * *